US009109562B2

(12) United States Patent
Tsutsui et al.

(10) Patent No.: US 9,109,562 B2
(45) Date of Patent: Aug. 18, 2015

(54) FUEL SUPPLY DEVICE FOR INTERNAL COMBUSTION ENGINE

(71) Applicant: HONDA MOTOR CO., LTD., Tokyo (JP)

(72) Inventors: Toshihiro Tsutsui, Wako (JP); Ryota Morinaga, Wako (JP)

(73) Assignee: HONDA MOTOR CO., LTD, Tokyo (JP)

( * ) Notice: Subject to any disclaimer, the term of this patent is extended or adjusted under 35 U.S.C. 154(b) by 278 days.

(21) Appl. No.: 13/934,343

(22) Filed: Jul. 3, 2013

(65) Prior Publication Data

US 2014/0026857 A1 Jan. 30, 2014

(30) Foreign Application Priority Data

Jul. 30, 2012 (JP) ..... 2012-168671

(51) Int. Cl.

| | |
|---|---|
| ***F02M 69/02*** | (2006.01) |
| ***F02M 37/04*** | (2006.01) |
| ***F02M 37/00*** | (2006.01) |
| *F02M 69/04* | (2006.01) |

(52) U.S. Cl.

CPC ..... *F02M 69/02* (2013.01); *F02M 37/007* (2013.01); *F02M 37/046* (2013.01); *F02M 69/044* (2013.01)

(58) Field of Classification Search

CPC ..... F02M 37/046; F02M 69/02; F02M 59/00

USPC ..... 123/447, 446, 495

See application file for complete search history.

(56) References Cited

U.S. PATENT DOCUMENTS

| | | | | |
|---|---|---|---|---|
| 3,952,719 | A * | 4/1976 | Fenton et al. | 123/198 DB |
| 4,928,390 | A * | 5/1990 | Gassen et al. | 30/123.4 |
| 5,027,758 | A * | 7/1991 | Siegler | 123/73 AD |
| 5,682,845 | A * | 11/1997 | Woody | 123/73 A |
| 8,413,639 | B2 * | 4/2013 | Kobayashi et al. | 123/511 |
| 2011/0303196 | A1 * | 12/2011 | Kobayashi | 123/495 |

FOREIGN PATENT DOCUMENTS

JP 64-73165 A 3/1989

* cited by examiner

*Primary Examiner* — Marguerite McMahon
*Assistant Examiner* — Tea Holbrook
(74) *Attorney, Agent, or Firm* — Westerman, Hattori, Daniels & Adrian, LLP

(57) ABSTRACT

A fuel supply device supplies fuel from a fuel tank to an injector by driving a diaphragm pump by use of pressure variation within a crankcase. The diaphragm pump includes: a pump casing; a diaphragm partitioning the interior of the pump casing into a negative pressure chamber and a pump chamber; and a plunger connected to the diaphragm and reciprocatively movable to and from the pump chamber. A pressure receiving area over which the plunger receives, at its end surface in a plunger advancing/retracting direction, pressure from the pump chamber is set smaller than a pressure receiving area over which the diaphragm receives pressure from the negative pressure chamber in the advancing/retracting direction.

5 Claims, 6 Drawing Sheets

FUEL SUPPLY DEVICE FOR INTERNAL COMBUSTION ENGINE

FIELD OF THE INVENTION

The present invention relates generally to fuel supply devices for internal combustion engines which include an injector for supplying fuel to an intake port, and more particularly to a technique for supplying fuel from a fuel tank to an injector by use of pressure variation within a crankcase.

BACKGROUND OF THE INVENTION

Among the conventionally-known schemes for supplying fuel from a fuel tank to an internal combustion engine are a first fuel supply scheme in which fuel is supplied from the fuel tank to a carburetor, and a second fuel supply scheme in which fuel is supplied from the fuel tank to an injector. The second fuel supply scheme has been popularly used in recent years because it allows a fuel injection amount of the injector to be controlled finely by means of an electronically-controlled fuel injection device. An example of such a fuel supply device for an internal combustion device is disclosed in Japanese Patent Application Laid-Open Publication No. SHO-64-73165 (hereinafter referred to as "the relevant patent literature").

The fuel supply device disclosed in the relevant patent literature comprises a combination of a transfer pump and a diaphragm pump, and it is employed particularly in a utility engine. The transfer pump transfers fuel from within the fuel tank to the diaphragm pump, and the diaphragm pump supplies the fuel, transferred by the transfer pump, to the injector by use of pressure variation within a crankcase.

Many of the commonly-known small-size utility engines are of a type which includes a manual recoil starter and a power generator (alternator) without including a battery. The transfer pump requires a drive source, such as an electric motor. A power generator of a relatively great power generating capability is required to secure activating electric power for the transfer-pump driving motor. Further, a great starting operation force is required to activate such a power generator of a relatively great power generating capability, and thus, the prior art fuel supply device still has room for improvement.

If the transfer pump requiring a drive source is dispensed with or omitted, another fuel supply scheme might be employed, in which the fuel pump is disposed above the diaphragm pump so that fuel can be supplied from the fuel tank to the diaphragm pump by gravitational force.

However, delivery pressure with which fuel is discharged or delivered by an ordinary diaphragm pump is relatively small. If the fuel delivery pressure is small, differential pressure before and behind an orifice provided at the distal end of the injector would become small. Such small differential pressure is disadvantageous if it is desired to increase accuracy of a flow rate of fuel to be supplied from the injector to a combustion chamber. Besides, in the case where the fuel delivery pressure is small, arrangements must be made for preventing so-called "vapor lock" even when the fuel is low in temperature. Note that the "vapor lock" is a phenomenon where air bubbles are produced by liquid fuel being vaporized by ambient heat and thus a fuel system is undesirably closed with the thus-produced air bubbles.

Further, in order to lubricate sliding portions accommodated in the crankcase, ordinary internal combustion engines are constructed to produce oil mist by stirring up and scattering lubricant oil within the crankcase. In case the oil mist enters the diaphragm pump, it can undesirably adhere to components parts within the diaphragm pump.

SUMMARY OF THE INVENTION

In view of the foregoing prior art problems, it is an object of the present invention to provide an improved technique capable of not only effectively preventing oil mist from entering the diaphragm pump from within the crankcase but also increasing the fuel delivery pressure by means of the diaphragm pump.

In order to accomplish the above-mentioned object, the present invention provides an improved fuel supply device for an internal combustion engine including an injector that supplies fuel into an intake port, the fuel supply device comprising: a fuel tank; a diaphragm pump for supplying fuel from the fuel tank to the injector by being driven by pressure variation within a crankcase of the internal combustion engine, the diaphragm pump including: a pump casing; a diaphragm partitioning the interior of the pump casing into at least a negative pressure chamber; a pump chamber defined in the pump casing; a plunger connected to the diaphragm in such a manner that the plunger is movable with the diaphragm in an advancing/retracting direction in the pump chamber; a coil spring normally urging the diaphragm in such a direction where the plunger advances in the pump chamber; and a fuel inlet port and a fuel delivery port communicating with the pump chamber, fuel introduced into the pump chamber via the fuel inlet port being deliverable to the fuel delivery port by the plunger advancing in the pump chamber; an oil separation pipe in the form of a pipe extending generally straight in a vertical direction and communicating with the interior of the crankcase; and an oil separator interposed between an upper-end opening of the oil separation pipe and the negative pressure chamber, the oil separation pipe and the oil separator being provided integrally on the pump casing. A pressure receiving area of the plunger over which the plunger receives, at an end surface thereof in the advancing/retracting direction, pressure from the pump chamber is set smaller than a pressure receiving area of the diaphragm over which the diaphragm receives pressure from the negative pressure chamber in the advancing/retracting direction.

On the pump casing are provided the oil separation pipe in the form of a pipe extending generally straight in the vertical (up-down) direction, and the oil separator interposed between the upper-end opening of the oil separation pipe and the negative pressure chamber. Thus, the present invention can sufficiently separate oil mist entering from within the crankcase and thereby effectively prevent the oil mist from entering the negative pressure chamber. Further, because the oil separation pipe is in the form of a pipe extending generally straight in the vertical direction, the oil mist can easily fall downward by gravitational force. Besides, because the oil separation pipe and the oil separator are provided integrally on the pump casing, the diaphragm pump can be constructed in a simplified manner.

Further, according to the present invention, the pressure receiving area of the plunger over which the plunger receives, at its end surface in the advancing/retracting direction plunger, pressure from the pump chamber is set smaller than the pressure receiving area of the diaphragm over which the diaphragm receives pressure from the negative pressure chamber in the advancing/retracting direction. Thus, the pressure of the fuel introduced from the fuel inlet port into the pump chamber can be increased by a ratio between the pressure receiving areas. In this way, the diaphragm pump of a booster type can be implemented with a simple construction.

Because the fuel delivery pressure by the diaphragm pump can increase as noted above, the present invention can increase accuracy of a flow rate of the fuel to be supplied from the injector to a combustion chamber. Besides, the present invention requires neither an electric supply means for supplying the fuel from the fuel tank to the diaphragm pump, nor an electric boost means for boosting pressure of the fuel to be supplied from the diaphragm pump to the injector.

Preferably, the pump casing integrally includes a pressure regulator communicating with a downstream portion of the fuel delivery port, and a return path for returning surplus fuel, discharged from the pressure regulator, back into the fuel tank. Thus, pressure of the fuel delivered from the fuel delivery port (fuel delivery pressure) can be maintained in a stable state not exceeding a predetermined pressure level. Besides, because the pressure regulator and the return path are provided integrally on the pump casing, they can be readily assembled to the diaphragm pump. Further, because the pressure regulator and the return path can be compactly assembled to the diaphragm pump, the fuel supply device of the invention can be significantly reduced in size.

Preferably, the pump casing integrally includes, upstream of the fuel inlet port, a fuel filter and a check valve for preventing back-flow of the fuel. Because the fuel filter and the check valve can be compactly assembled to the diaphragm pump, the fuel supply device of the invention can be significantly reduced in size.

Further, preferably, the diaphragm pump is mounted to a bottom section of the fuel tank, and the fuel inlet port is disposed within the bottom section of the fuel tank. Thus, no piping is required between the fuel tank and the fuel inlet port. Besides, it is possible to reduce a height from the bottom section of the fuel tank to the lower end surface of the diaphragm pump and thereby reduce the size of the fuel supply device of the invention.

Further, preferably, the oil separation pipe has a lower end portion directly inserted within the crankcase. Thus, it is possible to reduce a height from the fuel tank to the crankcase and hence the size of the fuel supply device of the invention.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

Certain preferred embodiments of the present invention will be described in detail below, by way of example only, with reference to the accompanying drawings, in which.

DETAILED DESCRIPTION OF THE INVENTION

Figure 1:
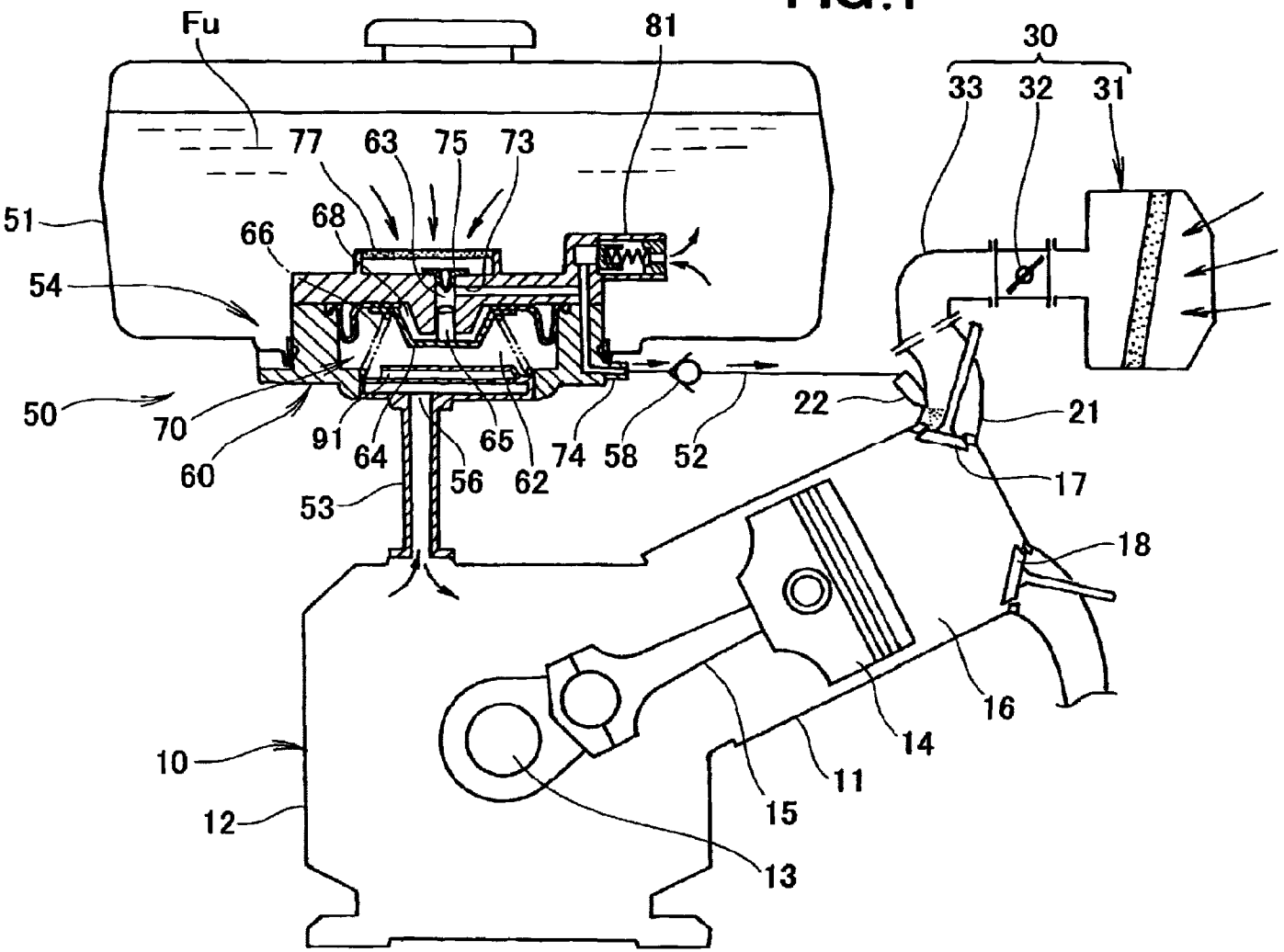
FIG. 1 is a view schematically showing an internal combustion engine provided with an embodiment of a fuel supply device of the present invention.

FIG. 1 schematically shows an internal combustion engine 10 provided with an embodiment of a fuel supply device 50 of the present invention. As shown in FIG. 1, the internal combustion engine 10, which is, for example, a transverse-mounted, single-cylinder four-cycle engine, includes as its main elements: a crankcase 12 integrally having a cylinder 11 oriented upward; a crankshaft 13 disposed horizontally; a piston 14; a con rod 15; a combustion chamber 16; an intake valve 17; and an exhaust valve 18.

An intake system 30 for the internal combustion engine 10 includes an air cleaner 31, a throttle valve 32 and an intake pipe 33. The intake pipe 33 is connected to an intake port 21 of the internal combustion engine 10. An injector 22 for supplying fuel Fu into the intake port 21 is provided in the intake port 21.

In order to lubricate sliding portions accommodated in the crankcase 12, the internal combustion engine 10 is constructed to produce oil mist within the crankcase 12 by stirring up and scattering lubricant oil within the crankcase 12. During operation of the internal combustion engine 10, great negative pressure and small positive pressure arise alternately within the crankcase 12.

The instant embodiment of the fuel supply device 50 for the internal combustion engine 10, which employs the gravitational-force-based fuel supply scheme, includes a fuel tank 51, a diaphragm pump (booster-type diaphragm pump) 60, a fuel supply path 52, and an oil separation pipe 53. In the fuel supply device 50, the fuel tank 51 is disposed above the internal combustion engine 10, and fuel Fu is supplied from the fuel tank 51 to the internal combustion engine 10 via the diaphragm pump 60, fuel supply path 52 and injector 22. A fuel-supply-path check valve 58 is provided partway along the fuel supply path 52, which allows the fuel to flow from the diaphragm pump 60 to the injector 22 but prevents the fuel from flowing from the injector 22 to the diaphragm pump 60.

The diaphragm pump 60 is mounted to a bottom section 54 of the fuel tank 51, so that the fuel can be gathered from within the fuel tank 51 to the diaphragm pump 60 by use of gravitational force.

The oil separation pipe 53 extends downward from the underside of the diaphragm pump 60 and is connected at its lower end to the crankcase 12. The oil separation pipe 53 is in communication with the respective interiors of the crankcase 12 and diaphragm pump 60, and it transmits the great negative pressure and small positive pressure to the diaphragm pump 60.

Further, the oil mist having entered the diaphragm pump 60 is returned back into the crankcase 12 along the oil separation pipe 53 by gravitational force. Because the fuel tank 51 and the diaphragm pump 60 are disposed above the crankcase 12, a mechanism for returning the oil mist from the diaphragm pump 60 back into the crankcase 12 can be constructed in a simple manner by merely providing the oil separation pipe 53 extending in a vertical (up-down) direction.

Figure 2:
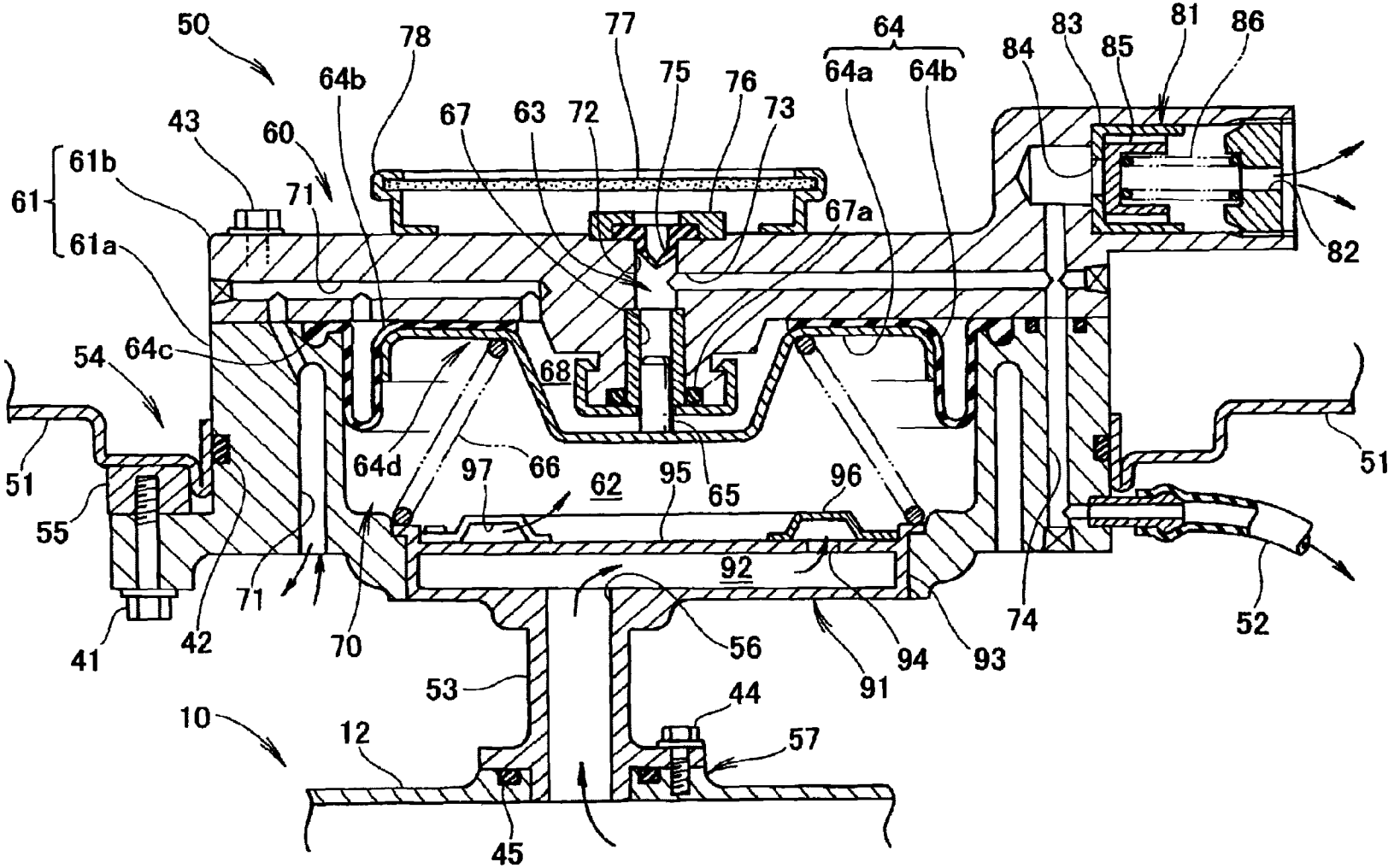
FIG. 2 is a sectional view of a diaphragm pump shown in FIG. 1.

The following paragraphs describe the diaphragm pump 60. As shown in FIG. 2, the diaphragm pump 60, which sends the fuel to the fuel supply path 52 by use of the negative pressure in the crankcase 12, includes: a pump casing 61; a diaphragm 64 partitioning the interior of the pump casing 61 into a negative pressure chamber 62 and a pump chamber 63; a plunger 65 connected to the diaphragm 64 and reciprocatively movable within the pump chamber 63; and a coil spring 66 provided in the negative pressure chamber 62 for normally urging the diaphragm 64 toward the pump chamber 63 in such a direction where the plunger 65 advances in the pump chamber 63. More specifically, a back-pressure chamber 68 is interposed between the pump chamber 63 and the diaphragm 64.

The pump casing 61 includes a casing body 61*a* and a lid section 61*b*, and the casing body 61*a* is fixed to a mounting seat 55 of the fuel tank 51 by means of a bolt 41. A seal member 42 seals between the casing body 61*a* and the fuel tank 51. The lid section 61*b* is fixed to the casing body 61*a* by means of a bolt 43.

The diaphragm 64 includes a hard metal section 64*a* supporting the plunger 65, and a soft section 64*b* disposed in and supported by the casing body 61*a* for holding the metal section 64*a*. The metal section 64*a* is sealingly adhered to the soft section 64*b*. The soft section 64*b* has an outward protrusion 64*c*, and the soft section 64*b* and the casing body 61*a* are sealingly fixed to each other by the outward protrusion 64*c* being pressed against the casing body 61*a*; thus, the negative pressure chamber 62 is maintained as a sealed space.

Further, the metal section 64*a* is movably supported by the soft section 64*b* and thereby allows the plunger 65 to move in the vertical (up-down) direction. The metal section 64*a* has the plunger 65 provided centrally thereon, and the metal section 64*a* has, on its side (lower side) from the side (upper side) having the plunger 65 provided thereon, a retention section 64*d* for retaining the coil spring 66 in place in such a manner as to surround the plunger 65.

The lid section 61*b* of the pump casing 61 has a cylinder section 67 provided therein, and the plunger 65 is slidably inserted in the cylinder section 67. Sealing is provided between the plunger 65 and the cylinder section 67 against leakage of fuel and air, and an O-ring 67*a* seals between the lid section 61*b* and the cylinder section 67. The diaphragm 64 is normally urged toward the pump chamber 63 by means of the coil spring 66. While the negative pressure chamber 62 is not in a negative pressure state, the plunger 65 is retained at its upper limit position where the pump chamber 63 has the smallest volume.

The back-pressure chamber 68 communicating with the atmosphere is interposed between the lid section 61*b* and the diaphragm 64. Communication passageways 71 are provided in the casing body 61*a* and the lid section 61*b*, and such communication passageways 71 communicate between the atmosphere and the back-pressure chamber 68. The negative pressure chamber 62 and the back-pressure chamber 68 together constitute a pump drive chamber 70.

As pressure in the interior of the negative pressure chamber 62 (i.e., interior pressure of the negative pressure chamber 62) becomes lower than the atmospheric pressure (i.e., becomes negative pressure), air flows into the back-pressure chamber 68, so that the force with which the diaphragm 64 is pressed downward by the atmospheric pressure becomes greater than the urging force with which the diaphragm 64 is pressed upward by the coil spring 66 and thus the diaphragm 64 moves downward.

As the interior pressure of the negative pressure chamber 62 becomes greater than the atmospheric pressure, a sum of the urging force with which the diaphragm 64 is pressed upward by the coil spring 66 and the force with which the diaphragm 64 is pressed upward by the interior pressure of the negative pressure chamber 62 becomes greater than the force with which the diaphragm 64 is pressed downward with the atmospheric pressure in the back-pressure chamber 68, and thus, the diaphragm 64 moves upward.

Further, the lid section 61*b* has a fuel inlet port 72 and a fuel delivery port 73 both provided therein in communication with the pump chamber 63. Further, the pump casing 61 has a fuel delivery path 74 provided therein in communication with the fuel delivery port 73. The fuel supply path 52 is connected to a downstream portion of the fuel delivery path 74.

A check valve 75 made of rubber and constructed to control fuel flows from the fuel tank 51 to the pump chamber 63 is provided in the fuel inlet port 72 of the lid section 61*b*. The check valve 75 is mounted on the lid section 61*b* by means of a valve fixing member 76, and it can be replaced with another check valve by removal of the valve fixing member 76.

A fuel filter 77 is provided on the lid section 61*b* in such a manner as to cover a region immediately over the check valve 75. The fuel filter 77 is mounted on the lid section 61*b* by means of a filter retaining member 78, and it can be replaced with another fuel filter by removal of the filter retaining member 78.

The lid section 61*b* integrally has a pressure regulator 81 communicating with a downstream portion of the fuel delivery port 73, and a return path 82 for returning surplus fuel, discharged from the pressure regulator 81, back into the fuel tank 51. The pressure regulator 81 includes: a case 83; a communication hole 84 provided in the case 83 and communicating with the fuel delivery path 74; a lid member 85 movably provided within the case 83 for closing the communication hole 84; and a spring 86 for normally urging the lid member 85 in a direction to close the communication hole 84.

As pressure in the interior of the fuel delivery path 74 gets high enough, the lid member 85 is pushed rightward in the figure to open the communication hole 84, so that the fuel within the fuel delivery path 74 can be returned back into the fuel tank 51 via the return path 82.

Further, the casing body 61*a* integrally includes the oil separation pipe 53 extending generally straight to communicate with the interior of the crankcase 12, and an oil separator 91 interposed between an opening 56 located at the upper end of the oil separation pipe 53 (i.e., upper-end opening 56 of the oil separation pipe 53) and the negative pressure chamber 62. The oil separation pipe 53 is fixed at its lower portion to a seat section 57 of the crankcase 12 by means of a bolt 44. A seal member 45 seals between the crankcase 12 and the oil separation pipe 53.

Figure 3:
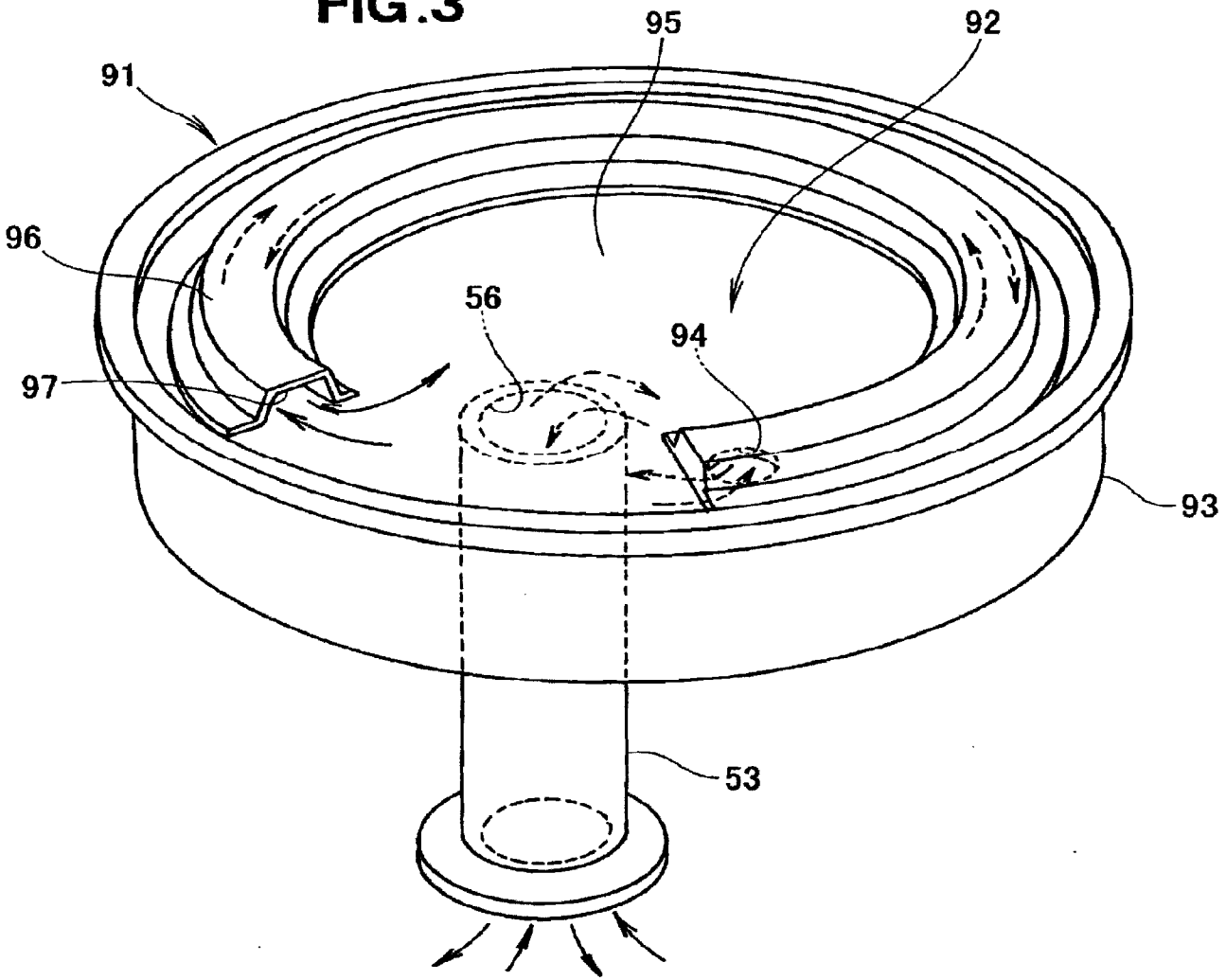
FIG. 3 is a perspective view of an oil separator shown in FIG. 2.

The following the oil separator 91. As shown in FIGS. 2 and 3, the oil separator 91 includes: an oil separator case 93 having a hollow preparatory chamber 92 formed therein; a through-hole 94 formed in a position thereof remote from the oil separation pipe 53 as viewed in plan; a helical separator 96 provided in a helical shape, extending from the through-hole 94, on the upper surface 95 of the oil separator case 93; and an outlet 97 provided at an end of the helical separator 96.

If the oil mist produced in the crankcase 12 flows to the oil separator 91, the oil can be separated through a mazy path comprising the preparatory chamber 92, through-hole 94 and helical separator 96. The helical separator 96 slants in such a manner that a portion thereof positionally corresponding to the through-hole 94 is located lowermost, and the preparatory chamber 92 slants in such a manner that a portion thereof corresponding to the opening 56 is located lowermost. Thus, the oil separated as above can be returned back into the crankcase 12. Note that the helical separator 96 is not limited to a length illustrated in the figures and may extend longer in a plurality of helical winds.

Figure 4:
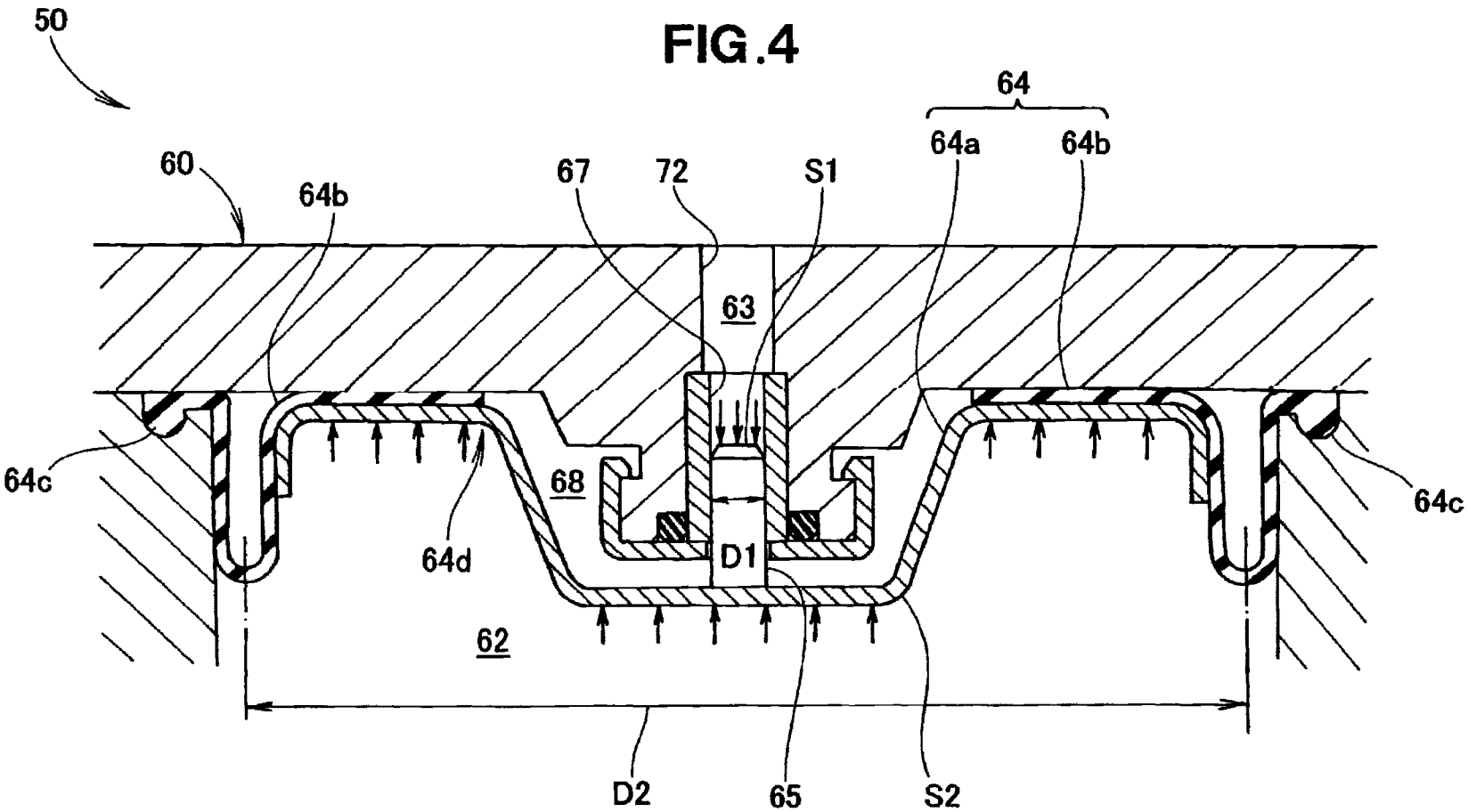
FIG. 4 is a view showing relationship between a plunger and a diaphragm shown in FIG. 2.

FIG. 4 shows relationship between the plunger 65 and the diaphragm 64. As shown in FIG. 4, the plunger 65 has an outer diameter D1, while the diaphragm 64 has an outer diameter D2 greater than the outer diameter D1 of the plunger 65 (i.e., D1<D2). A pressure receiving area S1 of the plunger 65 over which the plunger 65 receives, at its end surface in the plunger advancing/retracting direction, pressure from the pump chamber 63 is set smaller than a pressure receiving area S2 of the diaphragm 64 over which the diaphragm 64 receives pressure from the negative pressure chamber 62 in the plunger advancing/retracting direction, i.e. S1<S2. Thus, the pressure applied from the negative pressure chamber 62 becomes greater than the pressure applied from the pump chamber 63, so that the pressure of the fuel introduced from the fuel inlet port 72 into the pump chamber 63 can be increased by a ratio between the pressure receiving areas S1 and S2. In this way, the booster-type diaphragm pump 60 can be implemented with a simple construction.

Figure 5:
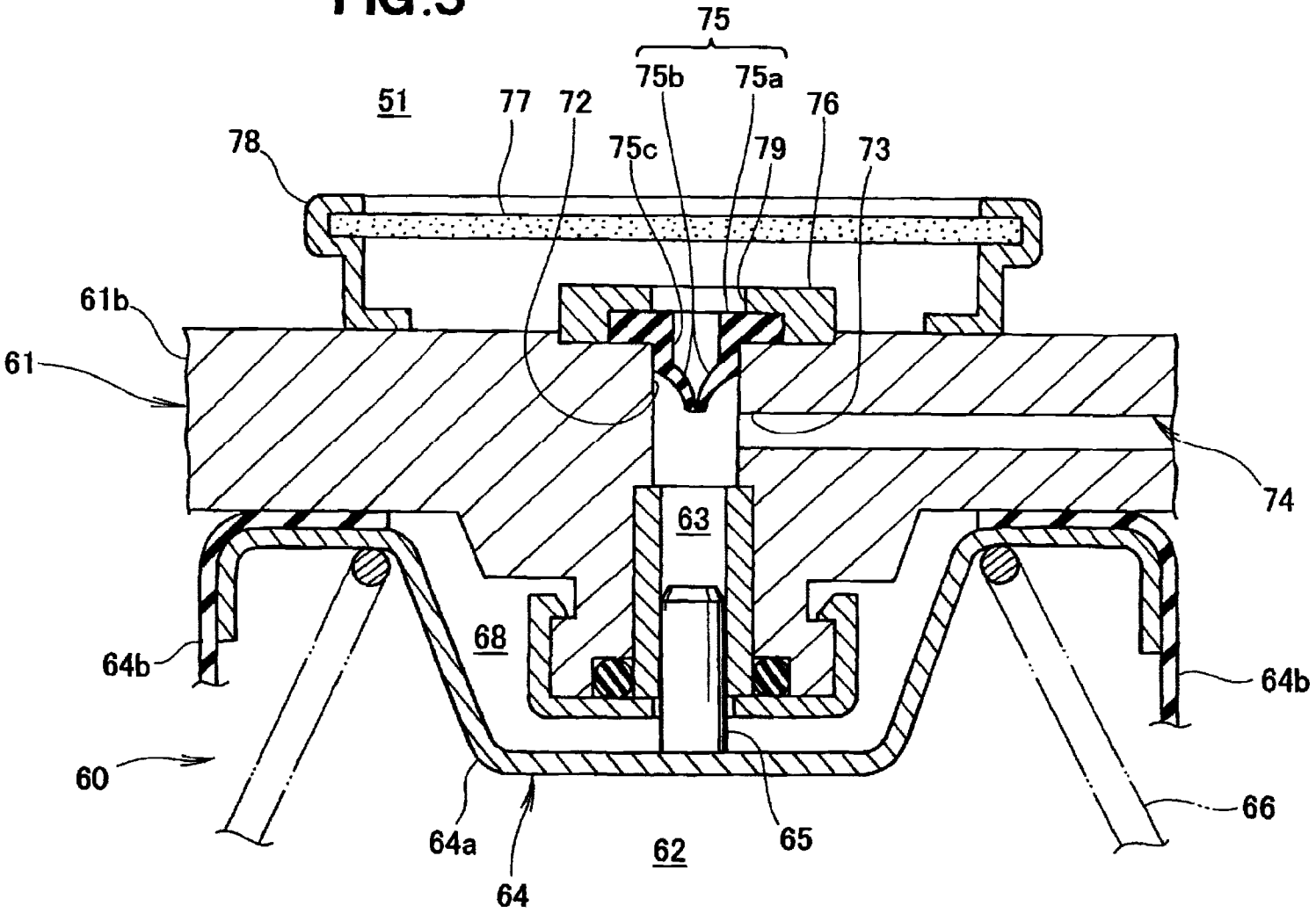
FIG. 5 is a view showing in enlarged scale principal elements of the diaphragm pump shown in FIG. 2.

The following paragraphs describe the check valve 75. As shown in FIG. 5, the check valve 75 is, for example, in the form of a rubber-made duckbill check valve. Namely, the check valve 75 comprises a seat section 75*a* fixed to the lid section 61*b* by means of the valve fixing member 76, and a pair of valve members 75*b* connecting to the seat section 75*a* and having an umbrella sectional shape. The two valve members 75*b* are provided in opposed relation to each other and together define a passageway 75*c* communicating with a hole 79 within the valve fixing member 76. The passageway 75*c* is closed with the opposed valve members 75*b* in a normal state.

Once the fuel from the fuel tank 51 enters the passageway 75*c* of the check valve 75, the valve members 75*b* are moved away from each other by being pushed by the fuel. As the plunger 65 ascends or advances in the pump chamber 63 and thus the interior pressure of the pump chamber 63 rises, the respective distal ends of the two valve members 75 are moved toward each other to abut against and press each other so as to be maintained in the closed state. In this manner, the check valve 75 operates to allow the fuel to pass or flow from the fuel tank 51 to the pump chamber 63 and prevent the fuel from flowing from the pump chamber 63 to the fuel tank 51.

Figure 6:
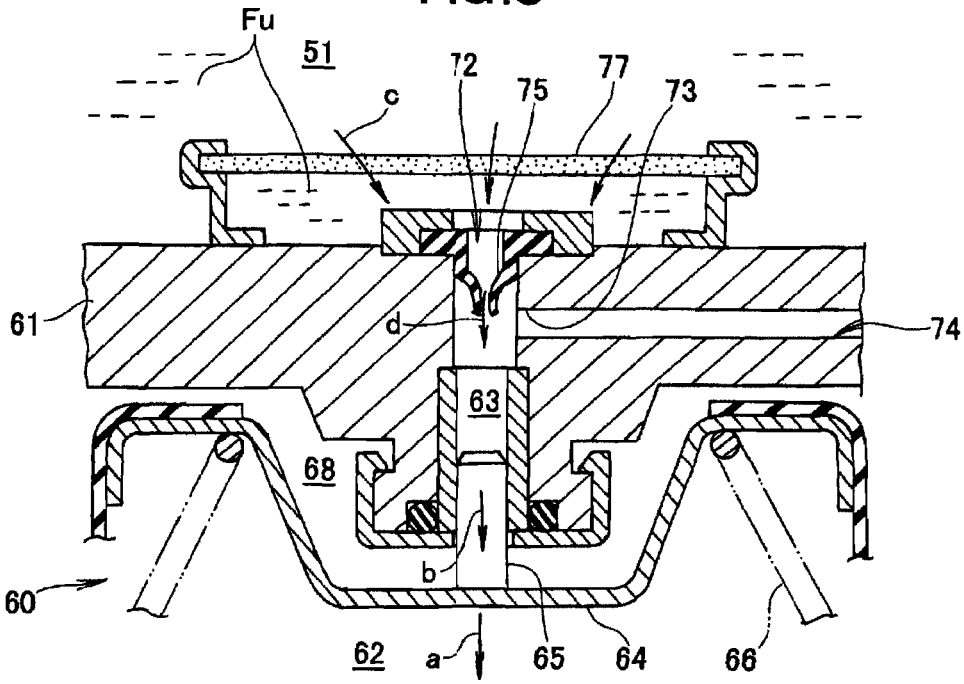
FIG. 6 is a view explanatory of how the embodiment of the fuel supply device behaves to cause fuel to flow from the diaphragm pump to a pump chamber.

The following describe how the instant embodiment of the fuel supply device behaves to cause the fuel to flow from the fuel tank 51 to the pump chamber 63. As shown in FIGS. 1 and 6, the piston 14 enters the combustion chamber 16 in response to rotation of the crankshaft 13. Then, the volume of the combustion chamber 16 decreases while the volume of the crankcase 12 increases so that the interior pressure of the crankcase 12 turns negative. As the interior pressure of the crankcase 12 changes to negative pressure like this, air in the negative pressure chamber 62 of the diaphragm pump 60 is also pulled via the oil separation pipe 53, in response to which the interior pressure of the negative pressure chamber 62 too turns negative.

As the interior pressure of the negative pressure chamber 62 turns negative, the diaphragm 64 moves toward the negative pressure chamber 62 as indicated by arrow a. Then, the plunger 65 descends or retracts in the pump chamber 63 as indicated by arrow b, so that the volume of the pump chamber 63 increases. Thus, the check valve 75 opens, so that the fuel in the fuel tank 51 flows through the fuel filter 77 as indicated by arrow c and then flows through the check valve 75 into the pump chamber 63 as indicated by arrow d.

Figure 7:
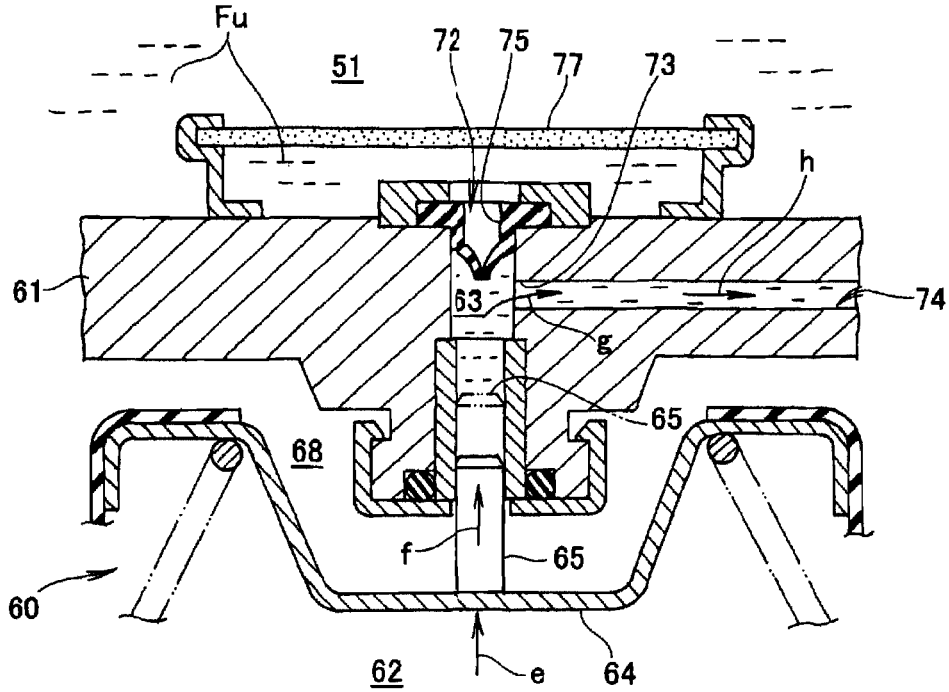
FIG. 7 is a view explanatory of how the embodiment of the fuel supply device behaves to deliver fuel from the diaphragm pump shown in FIG. 2.

The following describe how the instant embodiment of the fuel supply device behaves to deliver fuel from the pump chamber 63 to the fuel delivery port 73. As shown in FIGS. 1 and 7, the piston 14 retracts from the combustion chamber 16 in response to rotation of the crankshaft 13. Thus, the volume of the combustion chamber 16 increases while the volume of the crankcase 12 decreases, so that the interior of the crankcase 12 is compressed into positive pressure. As the interior pressure of the crankcase 12 turns positive like this, the air in the negative pressure chamber 62 of the diaphragm pump 60 too is compressed via the oil separation pipe 53, in response to which the interior pressure of the negative pressure chamber 62 too turns positive.

Once the interior pressure of the negative pressure chamber 62 turns positive, the diaphragm 64 ascends as indicated by arrow e, so that the plunger 65 ascends as indicated by arrow f to a plunger position indicated by imaginary line. Also, the check valve 75 is closed, and the fuel in the pump chamber 63 flows to the fuel delivery port 73 as indicated by arrow g. Further, the fuel passes through the fuel delivery path 74 as indicated by arrow h so that the fuel is supplied to the internal combustion chamber 10. By reciprocatively moving in accordance with the displacement of the diaphragm 64 as noted above, the plunger 65 can cause the interior volume of the pump chamber 63 to vary. As a consequence, the diaphragm pump 60 delivers the fuel.

The foregoing description about the instant embodiment of the fuel supply device 50 of the present invention may be summarized as follows.

On the pump casing 61, as shown in FIGS. 1 and 2, are provided the oil separation pipe 53 in the form of a pipe extending generally straight in the vertical direction, and the oil separator 91 interposed between the upper-end opening 56 of the oil separation pipe 53 and the negative pressure chamber 62. Thus, the instant embodiment of the fuel supply device 50 can sufficiently separate oil mist entering from within the crankcase 12 and thereby effectively prevent the oil mist from entering the negative pressure chamber 62. Further, because the oil separation pipe 53 is in the form of a pipe extending generally straight in the vertical direction, the oil mist can easily fall downward by gravitational force. Besides, because the oil separation pipe 53 and the oil separator 91 are provided integrally on the pump casing 61, the diaphragm pump 60 can be constructed in a simple manner.

Furthermore, the pressure receiving area of the plunger 65 over which the plunger 65 receives, at the end surface in the plunger advancing/retracting direction, receives pressure from the pump chamber 63 is set smaller than the pressure receiving area of the diaphragm 64 over which the diaphragm 64 receives pressure from the negative pressure chamber 62 in the plunger advancing/retracting direction. Thus, the pressure of the fuel introduced from the fuel inlet port 72 into the pump chamber 63 can be increased by a ratio between the pressure receiving areas. As a result, the booster-type diaphragm pump 60 can be implemented with a simple construction. Because the fuel delivery pressure by the diaphragm pump 60 can be increased, the instant embodiment can increase the accuracy of the flow rate of the fuel to be supplied from the injector 22 to the combustion chamber 16. Besides, the instant embodiment requires neither an electric supply means for supplying the fuel from the fuel tank 51 to the diaphragm pump 60, nor an electric boost means for boosting the pressure of the fuel to be supplied from the diaphragm pump 60 to the injector 22.

Further, as shown in FIGS. 1 and 2, the instant embodiment includes the pressure regulator 81 communicating with a downstream portion of the fuel delivery port 73, and the return path 82 for returning surplus fuel, discharged from the pressure regulator 81, back into the fuel tank 51. Thus, the delivery pressure from the fuel delivery port 73 can be maintained in a stable state not exceeding a predetermined pressure level. Besides, because the pressure regulator 81 and the return path 82 are provided integrally on the pump casing 61, they can be readily assembled to the diaphragm pump 60. Because the pressure regulator 81 and the return path 82 can be compactly assembled to the diaphragm pump 60, the instant embodiment of the fuel supply device 50 can be significantly reduced in size.

Further, as shown in FIG. 2, the pump casing 61 integrally includes, upstream of the fuel inlet port 72, the fuel filter 77 and the check valve 75 for preventing back-flow of the fuel. Because the fuel filter 77 and the check valve 75 can be compactly assembled to the diaphragm pump 60, the instant embodiment of the fuel supply device 50 of the invention can be significantly reduced in size.

Furthermore, as shown in FIG. 2, the diaphragm pump 60 is mounted on the bottom section 54 of the fuel tank 51, and the fuel inlet port 72 is disposed inside the bottom section 54. Thus, no piping is required between the fuel tank 51 and the fuel inlet port 72. Besides, it is possible to reduce a height from the bottom section 54 of the fuel tank 51 to the lower end surface of the diaphragm pump 60 and thereby reduce the size of the fuel supply device 50.

Furthermore, as shown in FIG. 2, the oil separation pipe 53 in the form of a pipe extending generally straight in the vertical direction has a lower end portion directly inserted within the crankcase 12, which can also reduce a height from the fuel tank 51 to the crankcase 12 and hence the size of the fuel supply device.

Whereas the check valve 75 has been described as being a duckbill valve, the present invention is not so limited, and the check valve 75 may be of any other type as long as it allows the fuel to flow from the fuel tank 51 to the pump chamber 63 and prevents the fuel from flowing from the pump chamber 63 to the fuel tank 51. Further, whereas the diaphragm 64 includes the hard metal section 64*a* and the soft section 64*b* integrated with each other adhesively, the present invention is not so limited, and the diaphragm 64 may be of any other type as long as it can reciprocate (advance and retract) the plunger 65 by use of pressure variation in the negative pressure chamber 62.

The fuel supply device for an internal combustion engine of the present invention is well suited for application to utility engines where a fuel tank is disposed above the internal combustion engine.

Obviously, various minor changes and modifications of the present invention are possible in light of the above teaching. It is therefore to be understood that within the scope of the appended claims the invention may be practiced otherwise than as specifically described.

What is claimed is:

1. A fuel supply device for an internal combustion engine including an injector that supplies fuel into an intake port, the fuel supply device comprising:

a fuel tank; and a diaphragm pump for supplying fuel from the fuel tank to the injector by being driven by pressure variation within a crankcase of the internal combustion engine, the diaphragm pump including: a pump casing; a diaphragm partitioning an interior of the pump casing into at least a negative pressure chamber; a pump chamber defined in the pump casing; a plunger connected to the diaphragm in such a manner that the plunger is movable with the diaphragm in an advancing/retracting direction in the pump chamber; a coil spring normally urging the diaphragm in such a direction where the plunger advances in the pump chamber; and a fuel inlet port and a fuel delivery port communicating with the pump chamber, fuel introduced into the pump chamber via the fuel inlet port being deliverable to the fuel delivery port by the plunger advancing in the pump chamber;

an oil separation pipe in a form of a pipe extending generally straight in a vertical direction and communicating with an interior of the crankcase; and an oil separator interposed between an upper-end opening of the oil separation pipe and the negative pressure chamber, the oil separation pipe and the oil separator being provided integrally on the pump casing, wherein a pressure receiving area of the plunger over which the plunger receives, at an end surface thereof in the advancing/retracting direction, pressure from the pump chamber is set smaller than a pressure receiving area of the diaphragm over which the diaphragm receives pressure from the negative pressure chamber in the advancing/retracting direction.

2. The fuel supply device for an internal combustion engine according to claim 1, wherein the pump casing integrally includes a pressure regulator communicating with a downstream portion of the fuel delivery port, and a return path for returning surplus fuel, discharged from the pressure regulator, back into the fuel tank.

3. The fuel supply device for an internal combustion engine according to claim 1, wherein the pump casing integrally includes, upstream of the fuel inlet port, a fuel filter and a check valve for preventing back-flow of the fuel.

4. The fuel supply device for an internal combustion engine according to claim 1, wherein the diaphragm pump is mounted to a bottom section of the fuel tank, and the fuel inlet port is disposed within the bottom section of the fuel tank.

5. The fuel supply device for an internal combustion engine according to claim 1, where the oil separation pipe has a lower end portion directly inserted within the crankcase.

* * * * *